US007298253B2

(12) United States Patent
Petricoin et al.

(10) Patent No.: US 7,298,253 B2
(45) Date of Patent: Nov. 20, 2007

(54) METHOD AND APPARATUS FOR DECIDING WHETHER TO ISSUE AN ALARM SIGNAL IN A SECURITY SYSTEM

(75) Inventors: Dennis Petricoin, Hemlock, NY (US); Steven A Markham, Rochester, NY (US); Craig A Hayden, Rochester, NY (US); Dennis M Caler, Marion, NY (US)

(73) Assignee: Robert Bosch GmbH, Stuttgart (DE)

( * ) Notice: Subject to any disclaimer, the term of this patent is extended or adjusted under 35 U.S.C. 154(b) by 151 days.

(21) Appl. No.: 11/103,147

(22) Filed: Apr. 11, 2005

(65) Prior Publication Data

US 2006/0226971 A1 Oct. 12, 2006

(51) Int. Cl.
*G08B 23/00* (2006.01)

(52) U.S. Cl. ..... 340/523; 340/508; 340/522; 340/541; 340/545.1

(58) Field of Classification Search ..... 340/506, 340/507, 508, 517, 521, 522, 523, 526, 529, 340/545.1, 541, 545.9, 825.06
See application file for complete search history.

(56) References Cited

U.S. PATENT DOCUMENTS 4,808,972 A * 2/1989 Nicholls ..... 340/541
4,821,027 A 4/1989 Mallory et al. ..... 340/521
4,833,449 A 5/1989 Gaffigan ..... 340/505
5,225,806 A 7/1993 Stanley-Arslanok et al.
5,781,108 A * 7/1998 Jacob et al. ..... 340/552
6,154,525 A 11/2000 Formosa ..... 379/42
6,157,299 A 12/2000 Wang
6,166,633 A 12/2000 Wang ..... 340/506
6,188,318 B1 2/2001 Katz et al.
6,198,389 B1 3/2001 Buccola ..... 340/517
6,909,921 B1 6/2005 Bilger
7,106,193 B2 * 9/2006 Kovach ..... 340/541
2002/0067259 A1 6/2002 Fufidio et al.
2002/0196155 A1 * 12/2002 McNulty, Jr. ..... 340/686.1
2003/0025599 A1 * 2/2003 Monroe ..... 340/531
2004/0059438 A1 3/2004 Sherlock
2004/0090327 A1 * 5/2004 Soloway et al. ..... 340/545.1
2005/0128067 A1 6/2005 Zakrewski
2005/0237176 A1 10/2005 Hammett

FOREIGN PATENT DOCUMENTS

JP 08 179050 A 7/1996

* cited by examiner

*Primary Examiner*—Brent A. Swarthout
(74) *Attorney, Agent, or Firm*—Baker & Daniels LLP

(57) ABSTRACT

A method of operating a security system includes providing a plurality of sensors, and detecting at least one event with the sensors. A decision whether to initiate an alarm signal is dependent upon the detecting by each of the sensors, which of the sensors has detected the at least one event, and what nonzero number of times a first of the sensors has detected the at least one event.

33 Claims, 5 Drawing Sheets

METHOD AND APPARATUS FOR DECIDING WHETHER TO ISSUE AN ALARM SIGNAL IN A SECURITY SYSTEM

BACKGROUND OF THE INVENTION

1. Field of the Invention

The present invention relates to surveillance systems that issue alarm signals, and, more particularly, to reducing the issuance of false alarm signals by such surveillance systems.

2. Description of the Related Art

Surveillance systems, also known as security systems, include security devices such as motion detectors for monitoring interior portions of a secured area of space, and door sensors and window sensors for monitoring perimeter portions of the secured area of space. When one of these sensors detects motion and/or the opening of a monitored door or window, the security system may issue an alarm signal that causes a siren to produce an audible alarm, and that is electronically communicated to a security company. The security company typically notifies the police, who may then visit the secured area of space in order to investigate.

A problem is that many of the alarm signals issued by a security system are what are known as "false alarms". False alarms are not the result of a genuinely dangerous condition, such as the presence of an intruder, but rather are a result of a resident of the building moving within the secured area of space and inadvertently causing an alarm signal to be issued. For example, a resident may, without knowing or remembering that the alarm system has been activated, open a door in order to let a dog outside, or walk into a ground floor area that is monitored while the residents sleep on an upper floor. The resulting audible alarm produced by a siren as a result of a false alarm typically wakes many sleeping people needlessly. Moreover, investigations of the false alarms by the police are a waste of community resources and may result in the owners of the security system being monetarily fined.

Another problem is that even if the alarm signal is caused by a would-be intruder, it may not be desirable to notify the police immediately. For instance, the would-be intruder may first need to gain access to the premises in order to rightly be considered a definite threat that is worthy of notifying the police about. The would-be intruder may open a window or door from the outside in order to gain access to the premises, just as a resident may open a door from the inside in order to let a dog out, as mentioned above. However, the would-be intruder opening the door or window alone may not qualify as a definite threat if the residents of the building are not in the building at the time. That is, after opening the door or window, the would-be intruder may discover that the premises is protected by the security system and then leave. The homeowner may indeed want the police to investigate, but it may not be necessary for the police to be called on to respond immediately, as may be necessary in a definite threat situation. Rather, it may be desirable for the police to be notified, and for the investigation to be conducted, after the residents have returned home, and at a time that is more convenient for both the police and the homeowner.

If, however, after opening the door or window, the would-be intruder climbs through the window and proceeds through a room or hallway that is monitored by a motion detector, it may be considered a definite threat worthy of notifying the police about. It may then be desirable for the security system to issue an alarm signal.

An approach to reducing the false alarm problem described above is known as "cross zoning." In cross zoning, two zones are said to be "crossed" when their individual areas of protection overlap one another. The system is installed and configured such that these two overlapping points are paired, i.e., "crossed". If only one of the detection devices is faulted and the other one is not faulted, the system considers this to be a false alarm condition and will not issue an alarm signal. When both of the "crossed zones" provide a fault condition, the system issues an alarm signal.

Another approach is known as "sequential verification," which is similar to cross zoning except that the two fault conditions that result in an alarm signal can originate from any two sensors in the security system. A single fault condition alone cannot cause an alarm signal to be issued. However, any subsequent fault condition after the first fault condition causes the alarm signal to be issued. This alarm response is sometimes referred to as a "confirmed" alarm, or, more precisely, a "sequentially confirmed alarm."

A problem with both the cross zoning approach and the sequential verification approach is that they do not differentiate between fault conditions in different types of sensors, and they do not differentiate between a Stay mode and an Away mode of security system operation when deciding whether to issue an alarm signal. More particularly, it may not be desirable to issue an alarm signal in response to only two fault conditions from an interior sensor. Rather, it may be more desirable to issue an alarm signal only after three or more fault conditions from an interior sensor. As another example, it may not be desirable to issue an alarm signal based upon fault conditions from a single door sensor alone. This is because the door may be repetitively opening and closing due to breezes, which would cause the door sensor to produce many fault conditions. Such multiple fault conditions from the door sensor should not by themselves cause an alarm signal to issue. Moreover, it may not be desirable to wait for a second fault condition from another type of sensor before issuing an alarm signal. For example, when there are people in the building whose safety may be at risk, it may be desirable to issue an alarm signal immediately after a single initial fault condition from a sensor that monitors a window that is not normally opened.

Another problem associated with the cross zoning approach is that setting up and configuring a traditional cross zone control requires significant time and effort, which makes the cross zone control less likely to be used. For example, an installer may be required to explicitly indicate which sensors are paired together to form a "cross zone". If the cross zone control is not used, then the goal of reducing false alarms is not realized.

What is needed in the art is a security system, and method of operation therefor, that provides a more sophisticated approach to deciding whether an alarm signal should be issued in response to various types and numbers of fault conditions. Yet, the security system and method of operation need to be simple to implement.

SUMMARY OF THE INVENTION

The present invention provides a security system that decides whether to issue an alarm signal based upon which sensors have produced a fault condition, how many times the sensors have produced fault conditions, the time period in which the fault conditions were produced, and whether the security system is operating in a Stay mode or an Away mode. The system assigns different levels of importance or criticality to different types of the sensors in deciding whether to initiate an alarm signal.

The invention comprises, in one form thereof, a method of operating a security system, including providing a plurality of sensors, and detecting at least one event with the sensors. A decision whether to initiate an alarm signal is dependent upon the detecting by each of the sensors, which of the sensors has detected the at least one event, and what nonzero number of times a first of the sensors has detected the at least one event.

The invention comprises, in another form thereof, a security system including a plurality of sensors. Each of the sensors being configured to detect at least one event. A control device is in communication with the sensors and decides whether to initiate an alarm signal dependent upon the detecting by each of the sensors, which of said sensors has detected the at least one event, and what nonzero number of times a first of the sensors has detected the at least one event.

The invention comprises, in yet another form thereof, a method of operating a security system, including providing a plurality of sensors, and categorizing each of the sensors in one of at least two categories. At least one event is detected with the sensors. An alarm signal is issued dependent upon the detecting. A sensor of a first of the categories must detect the at least one event twice in order to cause the alarm signal to be issued, and a sensor of a second of the categories may cause the alarm signal to be issued by detecting the at least one event only once.

The invention comprises, in still another form thereof, a method of operating a security system, including providing a plurality of sensors, and deciding whether to initiate an alarm signal dependent upon whether the security system is operating in a Stay mode or an Away mode. Each of the sensors is capable in each of the operating modes of independently causing a decision to initiate an alarm signal.

An advantage of the present invention is that false alarms are reduced by requiring a sensor of a certain type to produce three fault conditions in order to independently cause an alarm signal to be initiated. Moreover, a sensor of another type is prevented from independently causing an alarm signal to be initiated regardless of the number of fault conditions produced by the sensor.

Another advantage is that an alarm signal is issued as a result of only one fault condition produced by a sensor of a more critical type when the security system is operated in a Stay mode, thereby increasing the safety of the inhabitants of the secured area.

Yet another advantage is that programming and installation of the security system is simplified, thus making other advantageous features of the security system more likely to be used. Moreover, installation time is reduced.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
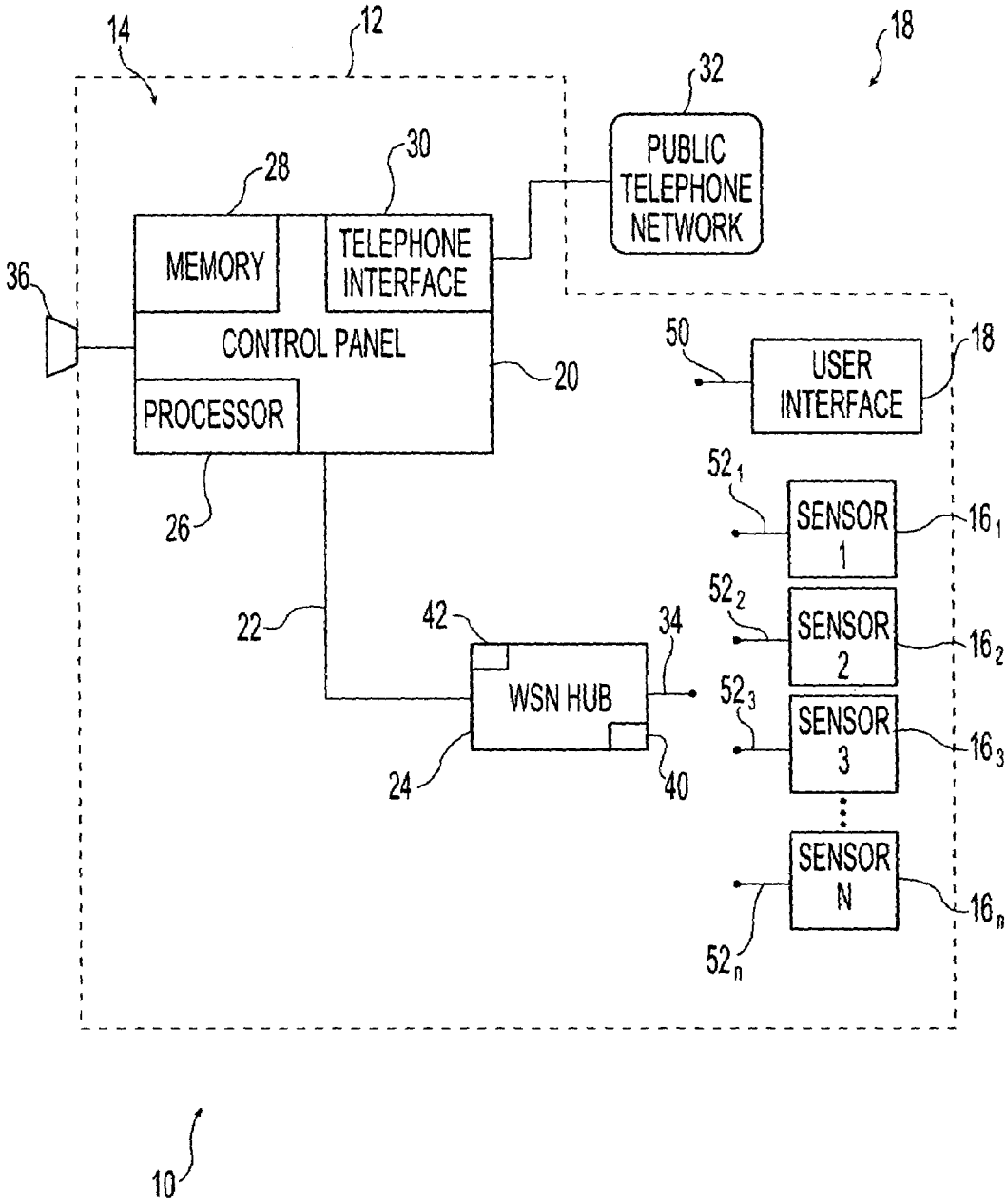
FIG. 1 is a block diagram of one embodiment of a security system of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings and particularly to FIG. 1, there is shown one embodiment of a security system 10 of the present invention for a structure 12 such as a building. However, system 10 may be used to secure other spaces, such as outdoor areas, subterranean rooms and passages, and zones of air space. System 10 includes a system controller 14, security sensors $\mathbf{16}_l$ through $\mathbf{16}_n$, and a user interface 18.

System controller 14 includes a control device in the form of a control panel 20 electrically connected via an option bus 22 to a wireless sensor network (WSN) hub 24. Control panel 20 may include a processor 26, a memory device 28 and a telephone interface 30. Processor 26 may coordinate communication with the various system components including WSN hub 24 and an audible alarm 36 associated with building 12. Memory 28 may include software for interpreting signals from sensor devices 16 and user interface 18, and deciding based thereon whether to initiate an alarm signal from control panel 20. The alarm signal may be used to activate audible alarm 36, or to notify a central station receiver (CSR) (not shown) such as a security company, fire station, or police station, for example, via public telephone network 32. After control panel 20 initiates an alarm signal, the alarm signal may be transmitted immediately to alarm 36 and/or to the CSR. Alternatively, after control panel 20 initiates an alarm signal, there may be a delay before the alarm signal is transmitted in order to provide the user time to abort the alarm signal transmission by entering a passcode in user interface 18 or by waving an identification token (not shown) near user interface 18. Memory 28 may also store identification information for sensors 16 so that control panel 20 can determine by analyzing a received signal which of sensors 16 transmitted the signal.

WSN hub 24 may include an antenna element 34 for transmitting and receiving air-borne signals, such as radio frequency signals. The radio frequency signals may be received by and transmitted from, i.e., exchanged with, sensors 16 and user interface 18. Information from sensors 16 and user interface 18 may be passed by WSN hub 24 to control panel 20 via option bus 22. Control panel 20 may pass information to WSN hub 24 via option bus 22 for transmission to sensors 16 and user interface 18 as necessary. WSN hub 24 may include a processor 40 and memory 42 for storing software and identification information associated with sensors 16 and user interface 18.

Figure 2:
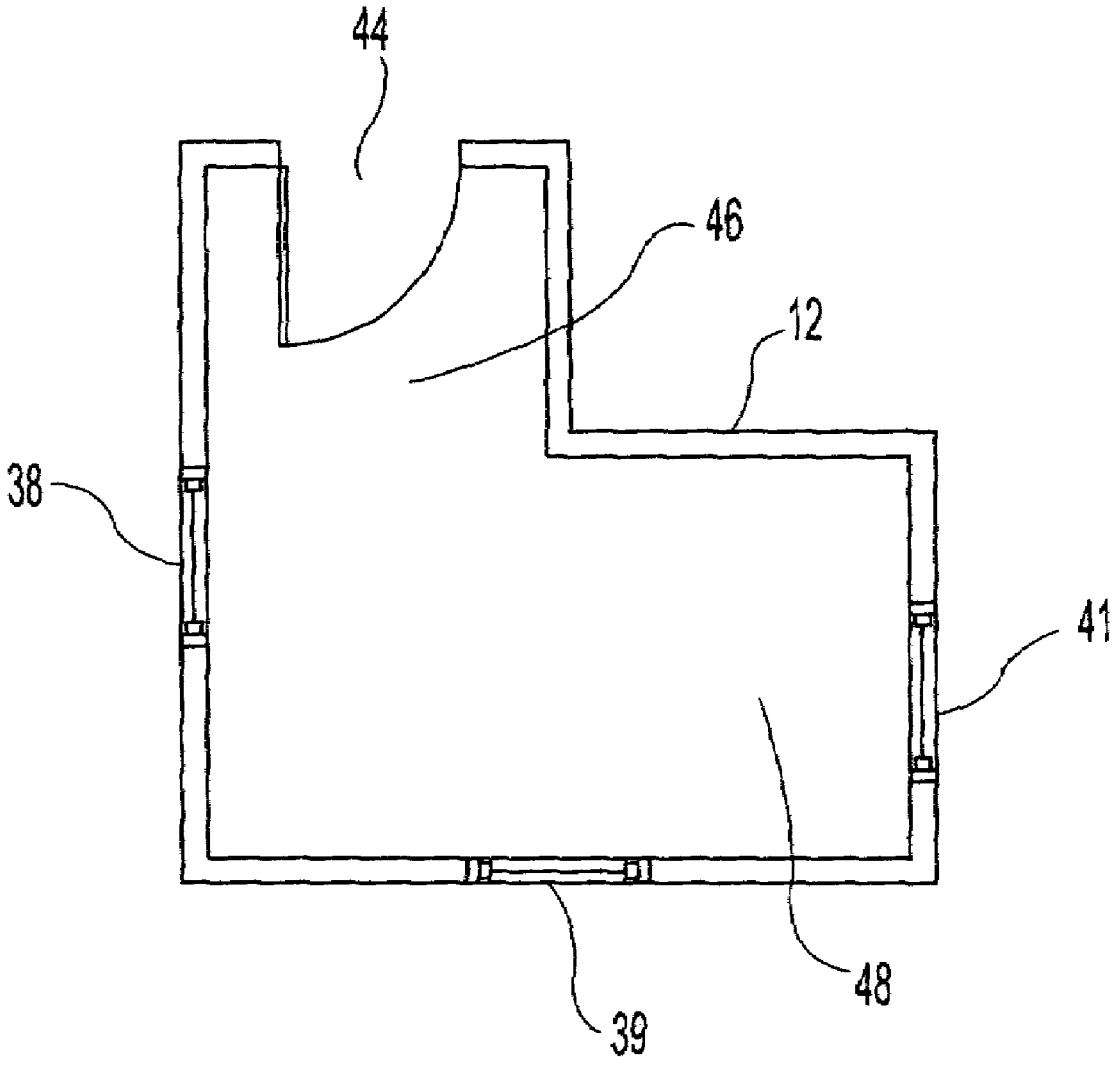
FIG. 2 is a plan view of an area monitored the security system of FIG. 1.

Sensors 16 may be in the form of any number or combination of perimeter sensors and interior sensors. The perimeter sensors may include window sensors and door sensors, for example. The interior sensors may include motion detectors. The window sensors may detect the opening and/or closing of a corresponding one of windows 38, 39 and 41 (FIG. 2). The door sensors may detect the opening and/or closing of a corresponding door, such as door 44. Door sensors are traditionally treated as "delay" sensors in that, after the door sensor detects that the corresponding door has been opened, there is a delay before the alarm signal is transmitted in order to provide the user time to abort the alarm signal transmission by entering a passcode in user interface 18 or by waving an identification token (not shown) near user interface 18. Conversely, window sensors are traditionally treated as "instant" sensors in that, after the window sensor detects that the corresponding window has been opened, the alarm signal is transmitted immediately. The motion sensors may each detect movement within a corresponding interior zone of the secured area, such as interior zones 46, 48.

Each sensor 16 may be wireless and may include a respective antenna element 52 for transmitting and receiving air-borne signals, such as radio frequency signals. The radio frequency signals may be received by and transmitted from, i.e., exchanged with, WSN hub 24.

User interface 18 may be wireless and may include an antenna element 50 for exchanging air-borne signals with WSN hub 24. User interface 18 may also include a keypad (not shown) or some other input that enables the user to select a mode of operation of security system 10. In one embodiment, the user may select between Stay and Away modes of operation or "arming states". In the Stay mode of operation, typically selected when people are expected to be sleeping in building 12, fault conditions produced by interior sensors are not considered, i.e., are ignored, when deciding whether to initiate an alarm signal. Rather, only fault conditions produced by perimeter sensors are considered. In the Away mode of operation, typically selected when building 12 is expected to be unoccupied by people, fault conditions produced by interior sensors as well as those produced by perimeter sensors are considered when deciding whether to initiate an alarm signal.

In addition to selecting between the Stay and Away modes, user interface 18 may also enable a user to select between a conventional mode of alarm signal initiation and an Intelligent Threat Assessment (ITA) mode of alarm signal initiation of the present invention, which is described in detail below. It may also be possible for the user to select the cross zoning or sequential verification modes of alarm signal initiation. In the conventional mode of alarm signal initiation, a single fault condition produced by any sensor may cause an alarm signal to be initiated. In the ITA mode of the present invention, in contrast, some combination of two or three fault conditions are required in order to initiate an alarm signal for most types of sensors. Moreover, in some scenarios, a fault condition must be produced by two different types of sensors before an alarm signal is initiated.

In the ITA mode, different numerical fault values may be assigned to fault conditions produced by different types of sensors. That is, the numerical value assigned may depend upon which sensor produced the fault condition, i.e., detected the event. Further, the fault value assigned to a fault condition of a particular sensor may also depend upon whether the security system is operating in the Stay mode or the Away mode. An alarm signal may be issued, or at least initiated, if an accumulated sum total or "count" of the fault values has a predetermined relationship to some threshold value, e.g., equals or exceeds a threshold value. Whether an alarm signal is initiated may also depend upon the points in time at which the fault conditions were produced. For example, in one embodiment, the accumulation or sum total of the fault values within a preceding sixty minute time period, or "verification window", must equal or exceed a threshold value in order for an alarm signal to be initiated.

In one particular embodiment of the ITA mode, the threshold value equals three, and the numerical fault values assigned to fault conditions are as shown in the table below:

| Sensor Type | Away Mode | Stay Mode |
|---|---|---|
| Perimeter Delay | 2 | 2 |
| Perimeter Instant | 2 | 3 |
| Interior | 1 | 0 |

An interior swinger shunt sensor is a type of interior sensor that may detect the opening of an interior door, such as a door between a garage and a living area of a house. It is not uncommon for such a door to be repetitively blown open and blown shut by the breeze, particularly if windows in the garage and living area are at least partially open. In order to avoid the situation where an alarm signal is initiated solely on the basis of such an interior door being repetitively blown open and closed, the contribution of an interior swinger shunt sensor to the fault count may be limited to two fault conditions within a given verification time window. That is, an interior swinger shunt sensor may contribute a value of two to the total fault count in the Away mode, but subsequent fault conditions produced by the interior swinger shunt sensor during the same verification time window will be ignored, i.e., will not be included in the running fault count. However, it is possible that one or two of the subsequent fault conditions may be included in a later verification time window that overlaps the earlier verification time window.

If, at the end of a verification time window, e.g., sixty minutes after a most recent fault condition, the accumulation of the fault values is at a value less than the threshold value, then the unverified fault condition(s) may be announced at user interface 18 at the time that the user disarms control panel 20 via user interface 18.

Figure 3:
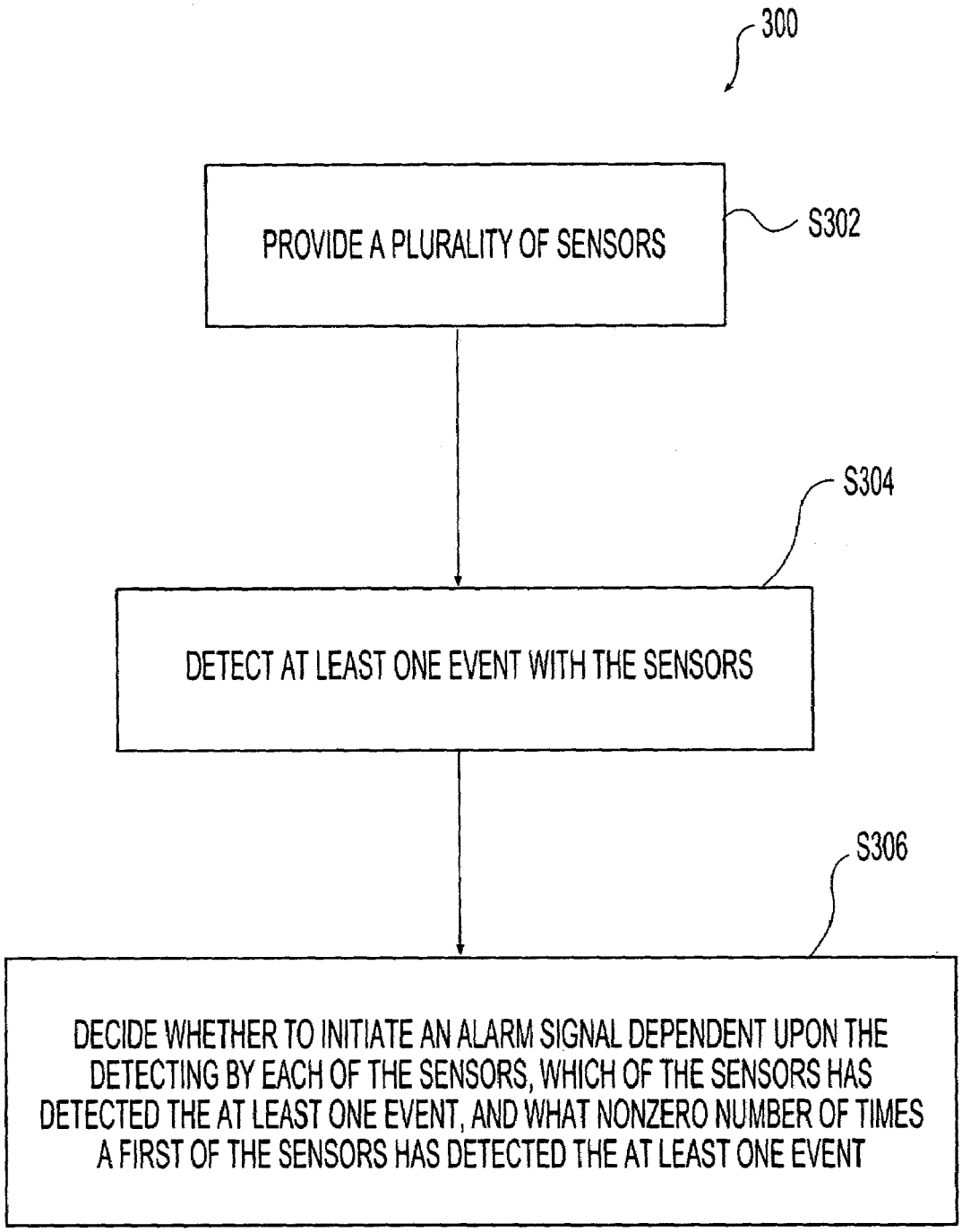
FIG. 3 is a flow chart of one embodiment of a method of operating a security system of the present invention.

One embodiment of a method 300 of operating security system 10 of the present invention is shown in FIG. 3. In a first step S302, a plurality of sensors are provided. For example, sensors 16 may be provided.

In a second step S304, at least one event is detected with the sensors. That is, sensors 16 may detect at least one event, including, for example, door 44 opening, one or more of windows 38, 39, 41 opening, or movement within one of interior zones 46, 48.

In a third step S306, it is decided whether to initiate an alarm signal dependent upon the detecting by each of the sensors, which of the sensors has detected the at least one event, and what nonzero number of times a first of the sensors has detected the at least one event. After an alarm signal is initiated, it is possible to issue an alarm signal immediately to a CSR and/or to audio alarm 36, or to provide a time delay before issuing the alarm signal in order to give the user an opportunity to abort the alarm signal by entering a passcode into user interface 18. In one embodiment, control panel 20 decides whether to initiate an alarm signal depending upon the detection performed by each of sensors 16, i.e., both interior and perimeter sensors, when system 10 is in an Away mode. In a Stay mode, control panel 20 may decide whether to initiate an alarm signal depending upon the detection performed by each of the perimeter sensors, but not depending upon any detection that may be performed by the interior sensors.

The decision by control panel 20 whether to initiate an alarm signal in step S306 may also be dependent upon which of sensors 16 has detected the at least one event. As shown in the table above, if a perimeter instant sensor has detected an event in the Stay mode, which has a fault value of three, equaling the threshold value, then an alarm signal may be initiated solely on that basis. However, if a perimeter delay sensor has detected an event in the Stay mode, which has a fault value of two, less than the threshold value of three, then an alarm signal is not initiated solely on that basis. Rather, there must be another detection of the at least one event by the perimeter delay sensor, or by any other of sensors 16, in order for an alarm signal to be initiated. In this way, the decision whether to initiate an alarm signal is dependent upon which of the sensors has detected the at least one event.

The decision by control panel 20 whether to initiate an alarm signal in step S306 may further be dependent upon what nonzero number of times a first of the sensors has detected the at least one event. For example, as is evident from the threshold value of three and the fault values in the above table, for all of the sensors except the perimeter instant sensor and the interior sensors in the Stay mode, the decision whether to initiate an alarm signal is dependent upon whether the sensor has detected the at least one event one or two times, which are both a nonzero number of times. That is, whether the accumulated count value at least equals three is dependent upon whether the fault value found in the table above and corresponding to the sensor is doubled or not.

The decision by control panel 20 whether to initiate an alarm signal may be dependent upon what nonzero number of times not only a first of the sensors, but also a second or third, etc. of the sensors has detected the at least one event. For example, in the Away mode in the embodiment of the table above, the decision may be dependent upon whether the at least one event was detected one or two times by each of the perimeter delay sensor(s), the perimeter instant sensor(s) and the interior sensor(s), considering each of the sensors individually and independently.

In the Stay mode, the decision by control panel 20 whether to initiate an alarm signal may be dependent upon what nonzero number of times a first of the sensors has detected the at least one event, and whether a second of said sensors has detected the at least one event, and may be independent of what nonzero number of times the second sensor has detected the at least one event. For example, the decision may be dependent upon whether the perimeter delay sensor has detected the at least one event once or twice, and whether the perimeter instant sensor has detected the at least one event, and may be independent of what nonzero number of times the perimeter instant sensor has detected the at least one event. That is, in determining whether the threshold number of three has been equaled or exceeded in the Stay mode, it may matter whether the perimeter delay sensor has produced a fault condition once or twice, and whether the perimeter instant sensor has produced any fault condition at all. However, it may not matter whether the perimeter instant sensor has produced a fault condition more than once because a single fault condition produced by the perimeter instant sensor may be sufficient to equal the threshold number of three.

Figure 4:
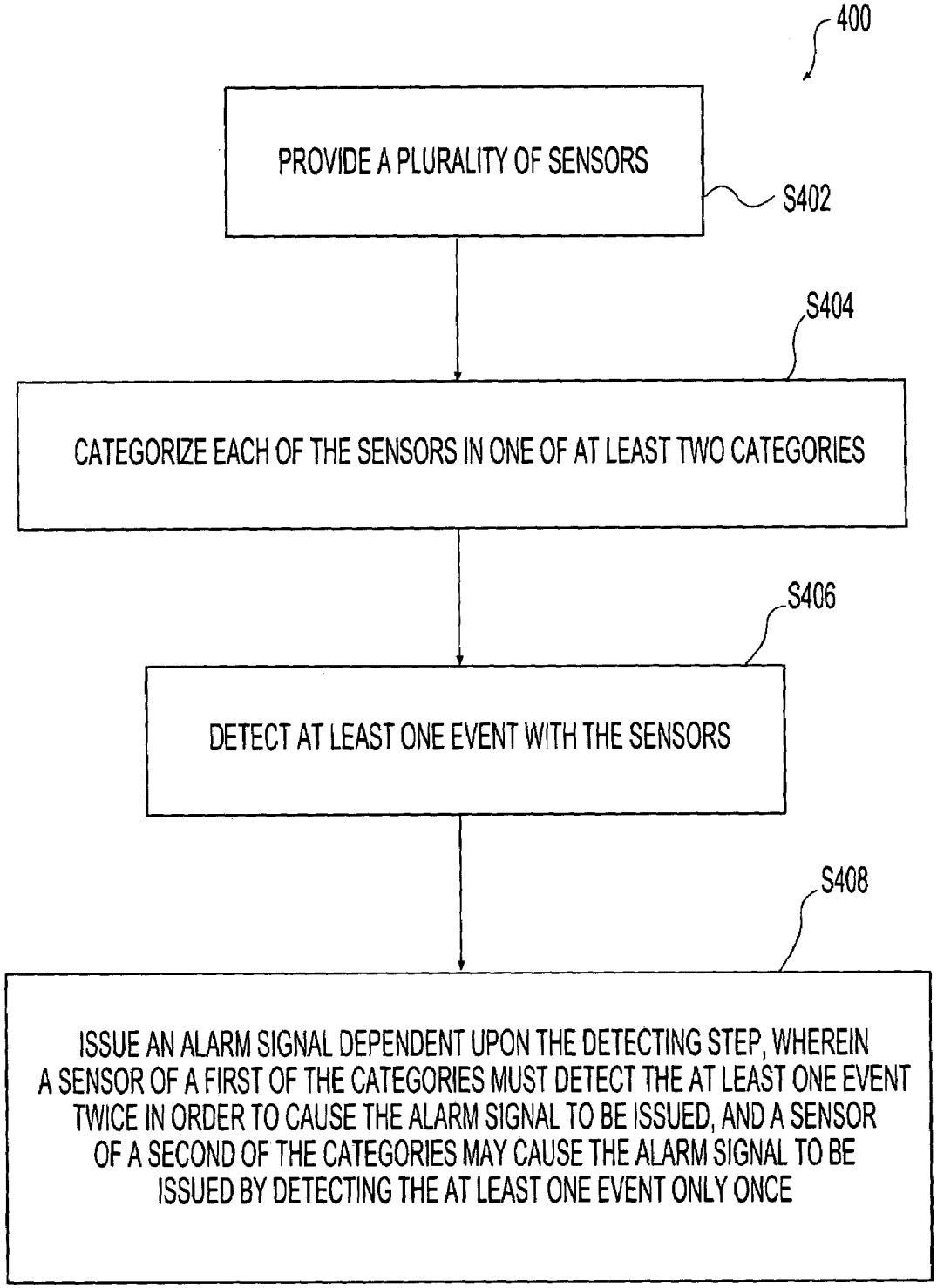
FIG. 4 is a flow chart of another embodiment of a method of operating a security system of the present invention.

Another embodiment of a method 400 of operating security system 10 of the present invention is shown in FIG. 4. In a first step S402, a plurality of sensors are provided. For example, sensors 16 may be provided.

In a second step S404, each of the sensors is categorized in one of at least two categories. For example, sensors may be categorized as perimeter delay sensors or perimeter instant sensors.

In a third step S406, at least one event is detected with the sensors. That is, the perimeter sensors may detect at least one event, including, for example, door 44 opening, or one or more of windows 38, 39, 41 opening.

In a fourth and final step S408, an alarm signal is issued dependent upon the detecting, wherein a sensor of a first of the categories must detect the at least one event twice in order to cause the alarm signal to be issued, and a sensor of a second of the categories may cause the alarm signal to be issued by detecting the at least one event only once. For example, control panel 20 may issue an alarm signal dependent upon the detecting performed by a perimeter delay sensor and a perimeter instant sensor. When control panel 20 is armed in the Stay mode, a perimeter delay sensor must detect the at least one event twice in order to cause the alarm signal to be issued, and a perimeter instant sensor may cause the alarm signal to be issued by detecting the at least one event only once, as may be determined from the table above. That is, in order to cause an alarm signal to be issued, two detections by a perimeter delay sensor, each having a fault value of two, are required to equal or exceed a threshold value of three; and a single detection by a perimeter instant sensor, having a fault value of three, is sufficient to equal the threshold value of three. If system 10 is switched out of the Stay mode and into the Away mode, an interior input sensor may have to detect the at least one event three times, each having a fault value of one, in order to for the total fault value to equal three and thereby cause the alarm signal to be issued.

Figure 5:
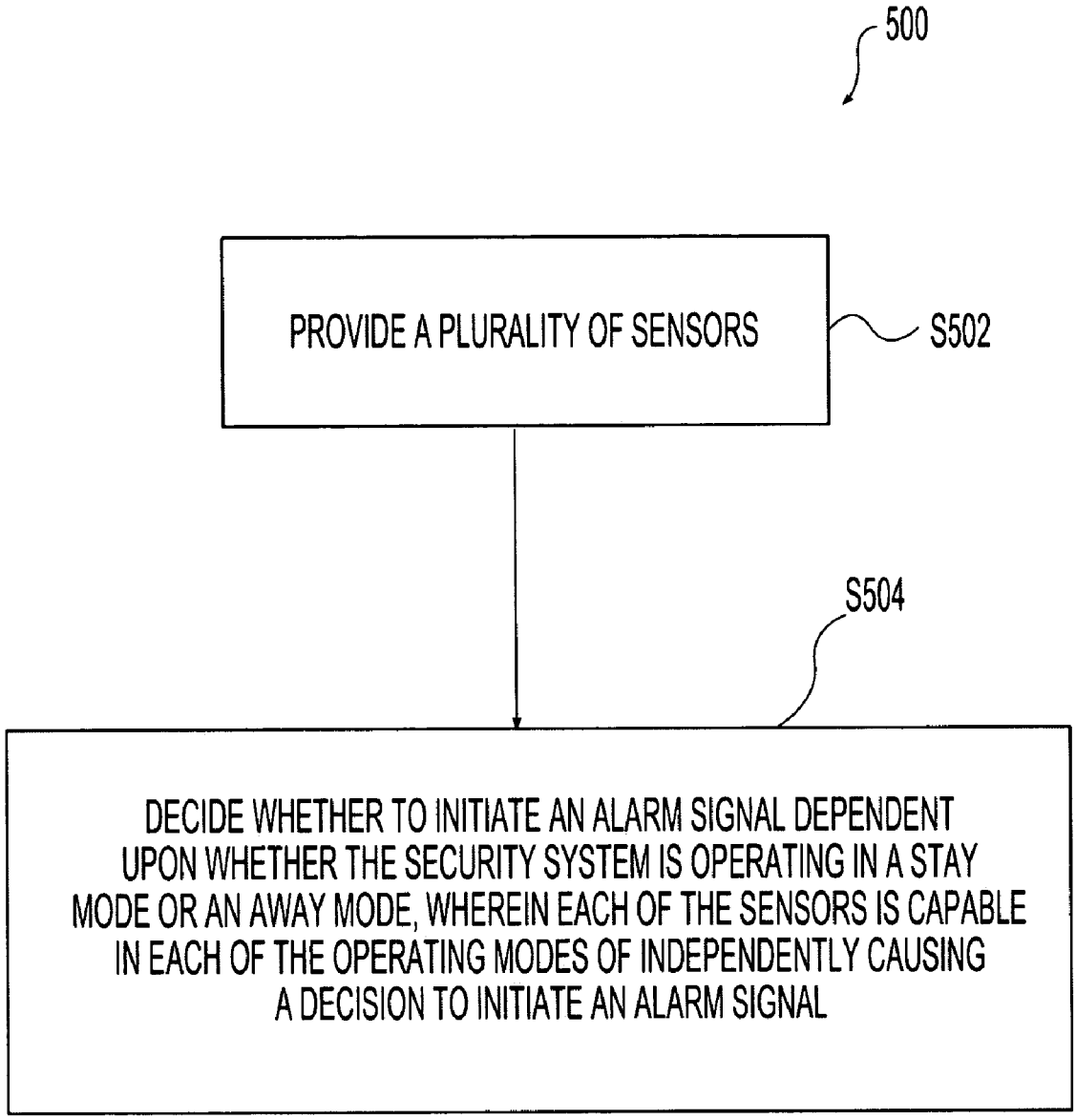
FIG. 5 is a flow chart of yet another embodiment of a method of operating a security system of the present invention.

Yet another embodiment of a method 500 of operating security system 10 of the present invention is shown in FIG. 5. In a first step S502, a plurality of sensors are provided. For example, a perimeter delay sensor and a perimeter instant sensor may be provided.

In a second step S504, it is decided whether to initiate an alarm signal dependent upon whether the security system is operating in a Stay mode or an Away mode, wherein each of the sensors is capable in each of the operating modes of independently causing a decision to initiate an alarm signal. For example, as shown in the table above, control panel 20 may use different fault values for fault conditions from a same perimeter instant sensor depending upon whether system 10 is operating in the Stay mode or the Away mode. More particularly, a fault condition from a perimeter instant sensor has a fault value of two in the Away mode and a fault value of three in the Stay mode. These different fault values used in the different modes may affect whether the total of the fault values equals or exceeds a threshold value. Thus, control panel 20 may decide whether to initiate an alarm signal dependent upon whether security system 10 is operating in the Stay mode or the Away mode. Moreover, each of the perimeter delay sensor and the perimeter instant sensor is capable in each of the operating modes of independently causing a decision to initiate an alarm signal. That is, two fault conditions from the perimeter delay sensor may be sufficient to cause a decision to initiate an alarm signal in either the Stay mode or the Away mode; two fault conditions from the perimeter instant sensor may be sufficient to cause a decision to initiate an alarm signal in the Away mode; and one fault condition from the perimeter instant sensor may be sufficient to cause a decision to initiate an alarm signal in the Stay mode.

The present invention has been described herein as deciding whether to initiate a fault signal by assigning different numerical fault values to fault conditions produced by different types of sensors, and determining whether a total of the fault values equals or exceeds a threshold value. However, it is to be understood that this is just one way of attributing different levels of criticality or importance to different sensors, and is intended as an example of an embodiment of the present invention, and not as a limitation on the scope of the present invention. It is possible within the scope of the invention to attribute different levels of criticality or importance to different sensors without assigning numerical values to the sensors' fault conditions. As an example, it is possible to specify in software code what combinations of fault conditions from what sensors are sufficient to cause an alarm signal to be initiated. As another example, a lookup table could be provided in memory that matches each possible combination and number of fault conditions from various sensors with the corresponding decision of whether or not to initiate an alarm signal.

An interior swinger shunt sensor has been described herein as having a limit of two of its fault conditions being contributed to the total fault value. It is to be understood that such a limit may additionally or alternatively be placed on any other type of sensor in the security system, such as on a perimeter sensor. Further, the limit on the number of a sensor's fault conditions that may contribute to the total fault value may be other than two, such as, for example, one.

While this invention has been described as having an exemplary design, the present invention may be further modified within the spirit and scope of this disclosure. This application is therefore intended to cover any variations, uses, or adaptations of the invention using its general principles.

What is claimed is:

1. A method of operating a security system, said method comprising the steps of:

providing a plurality of sensors;

detecting at least one event with said sensors;

deciding whether to initiate an alarm signal, said deciding being dependent upon:

said detecting by each of said sensors;

which of said sensors has detected the at least one event; and what nonzero number of times a first of said sensors has detected the at least one event; and assigning a numerical value to each of the event detections by said sensors, the numerical values being dependent upon which of said sensors made the event detection, said deciding step being dependent upon a sum of the numerical values.

2. The method of claim 1 wherein said deciding step is dependent upon a mode in which said security system is operating.

3. The method of claim 1 wherein said deciding step is dependent upon whether said security system is operating in a Stay mode or an Away mode.

4. The method of claim 1 wherein said deciding step is dependent upon points in time at which said sensors detect the at least one event.

5. The method of claim 1 wherein said deciding step is dependent upon a time period in which said sensors detect the at least one event.

6. The method of claim 1 wherein the alarm signal is issued if the sum of the numerical values has a predetermined relationship to a threshold value.

7. The method of claim 1 wherein said deciding step is dependent upon what nonzero number of times a second of said sensors has detected the at least one event.

8. The method of claim 1 wherein said deciding step is dependent upon what multiple number of times said first of said sensors has detected the at least one event.

9. The method of claim 1 wherein said deciding step is:

dependent upon a whether a second of said sensors has detected the at least one event; and independent of what nonzero number of times said second sensor has detected the at least one event.

10. A security system comprising:

a plurality of sensors, each of said sensors being configured to detect at least one event;

a control device in communication with said sensors and configured to decide whether to initiate an alarm signal dependent upon:

said detecting by each of said sensors;

which of said sensors has detected the at least one event; and what nonzero number of times a first of said sensors has detected the at least one event; and said control device also being configured to assign a numerical value to each of the event detections by said sensors, the numerical values being dependent upon which of said sensors made the event detection; and to initiate the alarm signal dependent upon a sum of the numerical values.

11. The system of claim 10 wherein said control device is configured to issue an alarm signal dependent upon a mode in which said security system is operating.

12. The system of claim 10 wherein said control device is configured to initiate an alarm signal dependent upon whether said security system is operating in a Stay mode or an Away mode.

13. The system of claim 10 wherein said control device is configured to initiate an alarm signal dependent upon points in time at which said sensors detect the at least one event.

14. The system of claim 10 wherein said control device is configured to initiate an alarm signal dependent upon a time period in which said sensors detect the at least one event.

15. The system of claim 10 wherein said control device is configured to initiate the alarm signal if the sum of the numerical values has a predetermined relationship to a threshold value.

16. The system of claim 10 wherein said control device is configured to initiate an alarm signal dependent upon what nonzero number of times a second of said sensors has detected the at least one event.

17. The system of claim 10 wherein said control device is configured to initiate an alarm signal:

dependent upon a whether a second of said sensors has detected the at least one event; and independent of what nonzero number of times said second sensor has detected the at least one event.

18. A method of operating a security system in Away and Stay modes of operation, said method comprising the steps of:

providing a plurality of sensors;

categorizing each of said sensors in one of at least two categories;

detecting at least one event with said sensors;

issuing an alarm signal dependent upon said detecting step, wherein a sensor of a first of the categories must detect the at least one event twice in order to cause the alarm signal to be issued, and a sensor of a second of the categories may cause the alarm signal to be issued by detecting the at least one event only once;

switching said security system to a Stay mode of operation; and deciding in the Stay mode whether to issue an alarm signal dependent upon said detecting step, wherein a sensor of a third of the categories must detect the at least one event three times in order to cause the alarm signal to be issued.

19. The method of claim 18 wherein said issuing step is dependent upon points in time at which said sensors detect the at least one event.

20. The method of claim 18 wherein said issuing step is dependent upon a time period in which said sensors detect the at least one event.

21. A method of operating a security system, said method comprising the steps of:

providing a plurality of sensors;

categorizing each of said sensors in one of at least two categories;

detecting at least one event with said sensors;

issuing an alarm signal dependent upon said detecting step, wherein a sensor of a first of the categories must detect the at least one event twice in order to cause the alarm signal to be issued, and a sensor of a second of the categories may cause the alarm signal to be issued by detecting the at least one event only once; and assigning a numerical value to each of the event detections by said sensors, the numerical values being dependent upon which of said sensors made the event detection, said issuing step being dependent upon a sum of the numerical values.

22. The method of claim 21 wherein said security system is operating in an Away mode.

23. The method of claim 22 comprising the further steps of:

switching said security system to a Stay mode of operation; and deciding in the Stay mode whether to issue an alarm signal dependent upon said detecting step, wherein a sensor of a third of the categories must detect the at least one event three times in order to cause the alarm signal to be issued.

24. The method of claim 21 wherein the alarm signal is issued if the sum of the numerical values has a predetermined relationship to a threshold value.

25. A method of operating a security system, said method comprising the steps of:

providing a plurality of sensors;

deciding whether to initiate an alarm signal dependent upon whether said security system is operating in a Stay mode or an Away mode, wherein each of said sensors is capable in each of the operating modes of independently causing a decision to initiate an alarm signal; and assigning a numerical value to each of at least one event detection by said sensors, the numerical values being dependent upon which of said sensors made the event detection and in which of the operating modes said security system is operating, said deciding step being dependent upon a sum of the numerical values.

26. The method of claim 25 comprising the further step of detecting at least one event with said sensors, wherein a decision to initiate an alarm signal may be caused by said detecting by any one of said sensors independently.

27. The method of claim 26 wherein a single detection of the at least one event by a first of said sensors is sufficient to cause a decision to initiate an alarm signal in the Stay mode, and two detections of the at least one event by said first sensor is required to cause a decision to initiate an alarm signal in the Away mode.

28. The method of claim 25 wherein said deciding step is dependent upon points in time at which said sensors detect the at least one event.

29. The method of claim 25 wherein said deciding step is dependent upon a time period in which said sensors detect the at least one event.

30. The method of claim 25 wherein the alarm signal is issued if the sum of the numerical values has a predetermined relationship to a threshold value.

31. The method of claim 1 further comprising attributing different levels of importance to events detected by the plurality of sensors, and wherein said deciding step is also dependent upon the importance attributed to each detected event.

32. The system of claim 10 wherein each detected event is attributed a level of importance, and wherein the control device is also configured to decide whether to initiate an alarm signal dependent upon the importance attributed to each detected event.

33. The method of claim 25 further comprising attributing different levels of importance to events detected by the plurality of sensors, and wherein said deciding step is also dependent upon the importance attributed to each detected event.

* * * * *